US012091803B2

(12) United States Patent
Moens

(10) Patent No.: US 12,091,803 B2
(45) Date of Patent: Sep. 17, 2024

(54) DEVICE FOR DOSING AND DISPENSING A DETERGENT COMPOSITION

(71) Applicant: Marnix Moens, Kampenhout (BE)

(72) Inventor: Marnix Moens, Kampenhout (BE)

( * ) Notice: Subject to any disclaimer, the term of this patent is extended or adjusted under 35 U.S.C. 154(b) by 831 days.

(21) Appl. No.: 17/050,409

(22) PCT Filed: Apr. 24, 2019

(86) PCT No.: PCT/EP2019/060490

§ 371 (c)(1),
(2) Date: Oct. 23, 2020

(87) PCT Pub. No.: WO2019/206980

PCT Pub. Date: Oct. 31, 2019

(65) Prior Publication Data

US 2021/0131017 A1 May 6, 2021

(30) Foreign Application Priority Data

Apr. 24, 2018 (EP) ..... 18169098

(51) Int. Cl.
*D06F 39/02* (2006.01)

(52) U.S. Cl.
CPC ..... *D06F 39/024* (2013.01)

(58) Field of Classification Search
None
See application file for complete search history.

(56) References Cited

U.S. PATENT DOCUMENTS 5,768,917 A 6/1998 Freida

FOREIGN PATENT DOCUMENTS

EP 2 465 995 6/2012
WO WO 2004/018760 3/2004

*Primary Examiner* — Levon J Shahinian
(74) *Attorney, Agent, or Firm* — Levy & Grandinetti

(57) ABSTRACT

A device for dosing and dispensing a detergent composition has a reservoir wherein the surface of the reservoir comprises a plurality of ball retainers in which a freely rotating ball is seated.

19 Claims, 7 Drawing Sheets

DEVICE FOR DOSING AND DISPENSING A DETERGENT COMPOSITION

FIELD OF THE INVENTION

A device for dosing and dispensing a detergent composition, said device comprising: a reservoir (1) characterized in that the surface of the reservoir comprises a plurality of ball retainers (2) wherein a freely rotating ball (3) is seated

BACKGROUND OF THE INVENTION

Detergent dosing and dispensing devices known in the art and used during cleaning processes. Typically the device is filled with the detergent and, thus filled, it is placed in the drum of the machine, where the fabrics are already present, the detergent composition contained in the device being progressively distributed in the course of washing within the washing medium and within the fabrics. Said devices dispense the detergent randomly throughout the washing liquor in the washing machine. Upon leaving the dosing device, the detergent composition will substantially enter in contact with only specific items present in the washing machine and adhere to them. Since only a minimum concentration of cleaning solution will reach the rest of the items, these items will sometimes have to be rewashed.

Therefore it is clear from the above that there remains a need on the market for a dosing and dispensing device which provides for both an improved dispensing and at the same time improved contact with the wash items thereby ensuring a more efficient laundry cleaning process.

It is desirable to have available a simple process capable of being implemented with inexpensive devices, in order to solve simultaneously a number of technical problems which arise with the detergent compositions currently available commercially. A main problem results from the fact that it is desirable to perform the washing of fabrics with a detergent composition whose constituents exert their activity at the moment of contact with the fabric. The detergent must be available at the contact with the items to be washed during the washing cycle and the technical problem to be solved is to find a simple and practical process to make available a detergent composition, which proceeds according to an optimum sequence upon contacting the items to be washed.

It is a further object of the present invention to provide a device capable of controlling the dispensing of the detergent composition, upon contact with the fabric, throughout the maximum duration possible of the cleaning process.

SUMMARY OF THE INVENTION

The present invention is directed to a device for dosing and dispensing a detergent composition, said device comprising a reservoir (1) characterized in that the surface of the reservoir comprises a plurality of ball retainers (2) wherein a freely rotating ball (3) is seated.

According to one embodiment whereby said freely rotating balls (3) occupy 70%, 60%, 40%, 30%, 10% or more preferably at least 20% of the surface of the reservoir (1).

According to another embodiment the surface of the ball is textured.

According to another embodiment the interior surfaces of the recesses of the ball retainers (2) have a smooth surface or are made out of a material different than the material of the rotating ball.

According to a specific embodiment the device is spherical and whereby the device ranges from 6 to 10 cm in diameter having balls in the range of 0.5 to 2.5 cm, preferably 1 to 2 cm in diameter.

According to a preferred embodiment, the device has 360 degrees dispensing ability In a further embodiment said reservoir has fixation means for receiving a detergent, said detergent being present as such or in the form of a tablet, pouch (4), water soluble pouch or present in an additional reservoir.

In yet another embodiment the distance between the detergent and the container (1) is such to allow mixing and dispensing of the detergent towards the inner surface of the container (1).

In a particular embodiment, the device for dosing and dispensing a detergent composition comprises:

an inner reservoir (5) comprising at least an opening (6)

an outer reservoir (1)

The inner reservoir (5) is contained in the outer reservoir (1)

Characterized in that surface of the outer reservoir (1) comprises a plurality of ball retainers (2) wherein a freely rotating ball (3) is seated.

In a further embodiment the inner reservoir (5) comprises at least two compartments (5*a*, 5*b*).

In another embodiment the inner reservoir (5) defines a space in view of the outer reservoir (1) to allow mixing and dispensing of the detergent towards the inner surface of the container (1).

In a further embodiment the inner reservoir (5) comprises a plurality of openings on its surface.

In a specific embodiment the freely rotating balls (3) are made from a material selected from a group comprising: plastic, rubber or fiber.

According to another embodiment wherein the inner reservoir (5) is dissolvable in water and/or the inner reservoir (5) is interchangeable.

In a further embodiment, the present invention is directed to a kit of parts comprising:

A detergent composition

A device for dosing and dispensing the detergent composition comprising an inner reservoir (5) having at least an opening (6), an outer reservoir (1), wherein the inner reservoir (5) is contained in the outer reservoir (1), the outer reservoir (1) further comprises a plurality of ball retainers (2) wherein a freely rotating ball (3) is seated on the exterior surface of said device

DESCRIPTION OF THE INVENTION

In the context of the present invention, a detergent composition is to be understood as any type of product used in the cleaning process of textiles, like for example: cleaning agent (liquid or solid form such as: powder, granular and/r agglomerates and/or flakes), softener, rinsing solution, salt or a combination thereof. The detergent composition may comprise washing additives, like bleaches, enzymes or the like. The term liquid is meant to include liquid, paste, waxy or gel compositions. The detergent may be present as such in the form of a table or present in a water soluble pouch FIG. 1(7) or may be present in an additional container, further referred to as inner reservoir(5).

As a result of the present invention, the detergent composition, which in an initial state is highly viscous, will exit the device in a diluted state triggered by the contact of the items to be washed. By controlling the dispensing of the detergent via the freely rotating balls, the cleaning efficiency is at the same time improved, due to the contact of the washing items with the freely rotating balls. The result is a more controlled homogenized liquor within the entire washing machine, with a maximum degree of cleaning efficiency upon contact with the fabric.

Furthermore, the internal movement of the washing machine induces a rotational movement of the device and also constantly changes the trajectory of said device. Accordingly, the device itself comes in intense contact with the items to be washed and considerably enhances the cleaning process as the device will have a physical cleaning ability because of the freely rotating balls (3). At the same time, a quantity of detergent composition will be released from the device and enter in direct contact with the items to be washed, creating a powerful synergetic effect between the physical cleaning ability of the device and the cleaning ability of the detergent composition.

An advantage of this synergetic effect is that the washing process is more efficient with a better result in removing difficult stains. Another advantage is that the washing process is cost and time effective as the time, quantity of detergent composition and water are reduced significantly.

Figure 1:
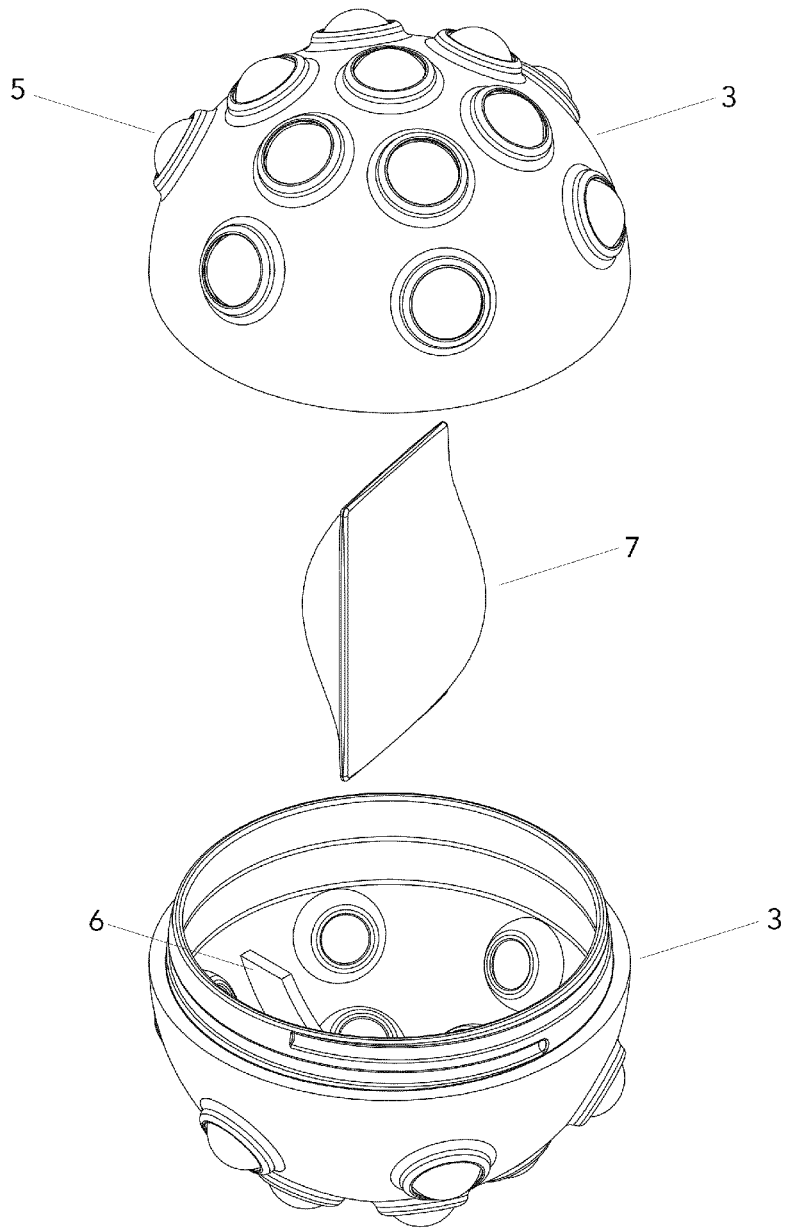
FIG. 1 schematically represents a device for dosing and dispersing a detergent composition according to the present invention FIGS. 2 and 3 schematically represents details re a ball retainer on the reservoir's surface of said device of wherein a freely rotating ball is seated FIG. 4 schematically represents a device for dosing and dispersing a detergent composition according to the present invention having an inner and outer reservoir.
Figure 2:
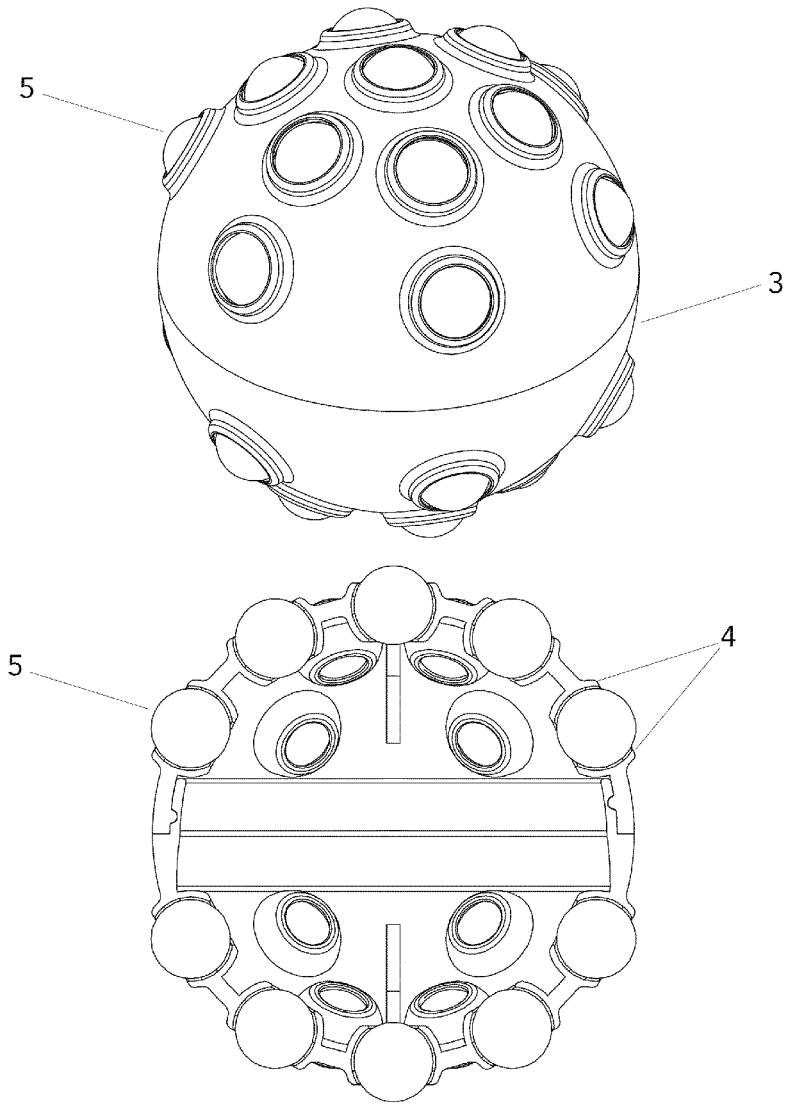

A plurality of spherical recesses are formed in the surface of the exterior reservoir. By "Spherical" in this context means that the recess's surface conforms to a portion of the surface of a sphere, not that the recess forms a complete sphere.) The recesses may be in any convenient pattern which provides for free rotation of the balls, each of which is seated in a separate recess and keeps them from interfering with each other. A typical pattern is shown in FIGS. 1 and 2. It will be evident that there can be more or less balls and that they can be distributed in other patterns across the surface. The particular number of balls may vary, although the use of 12 to 26 balls, with 2 centrally of the others as generally shown in FIG. 1.

Each of the balls will be seated in its recess such that it may rotate freely with a small amount of clearance such that the detergent may flow across the surface of recess and be in contact with the surface of the ball. In order to enhance the pickup of detergent by the surface of ball 8, the ball surface may be textured. In such case, the interior surfaces of the recesses (4) should ideally have a smooth surface or made out of a material different than the material of the retaining ball.

The device of this invention may be of any size which will hold a significant amount of detergent. Ideally the device should have a spherical container.

In accordance with the present invention, the spherical container has optimized performance due the 360 degrees dispensing ability. Commonly the device will range from 6 to 10 cm in diameter with each of the balls being in the range of 0.5 to 2.5 cm, preferably 1 to 2 cm in diameter. Smaller devices can be constructed by reducing the number of balls and their size and conversely larger devices may be constructed. With the larger devices it is preferable to retain the balls at the size referred to above and increase the number of balls in proportion to the size of the device, rather than having a small number of larger balls, since the use of more small balls provides for greater efficiency in applying and distributing the liquid to the fabrics' surface.

The multiple ball retainers on the container's surface wherein a freely rotating ball is seated serve two major functions. First, because of the size difference (specified to a certain tolerance) of the ball retainer and the freely rotating ball, a gap is created between the rotating ball and the ball retainer. This creates a passage for both water and detergent to flow through, thus enhancing the dissolving and dispensing process of the detergent.

It is also this size difference between the rotating ball and the ball retainer that provide a secondary function. The ball can freely rotate within the ball retainer due to the gap created by this size difference. Upon contact with the item to be washed, the rotating of the ball triggers a dispensing effect of the detergent as well as a mechanical cleaning such as rubbing effect of the detergent on the items to be washed. In order to provide the most efficient rubbing effect, the rotating ball's material surface may be textured or comprise a degree of surface roughness.

Preferably either one or both of the inner surfaces of the device (3) comprise fixing means such as fins (6), securing the detergents within the device (3). Said fixing means also have an effect of dispensing and guiding the detergent composition towards the freely rotating balls (3) embedded at the surface (3), and also improve the dissolving process. The fixing means may be such that a distance is created between the detergent and the rotating balls in order to allow optimum solubility, such as for example water soluble pouches (4).

Figure 3:
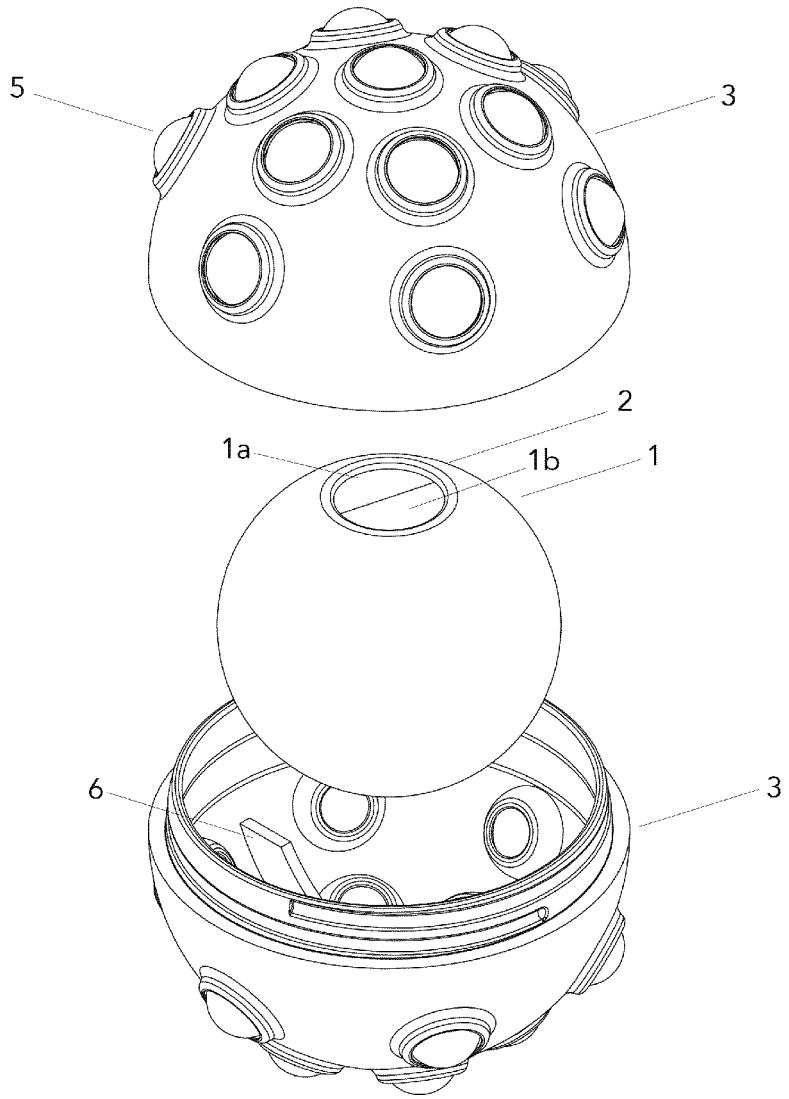
Figure 4:
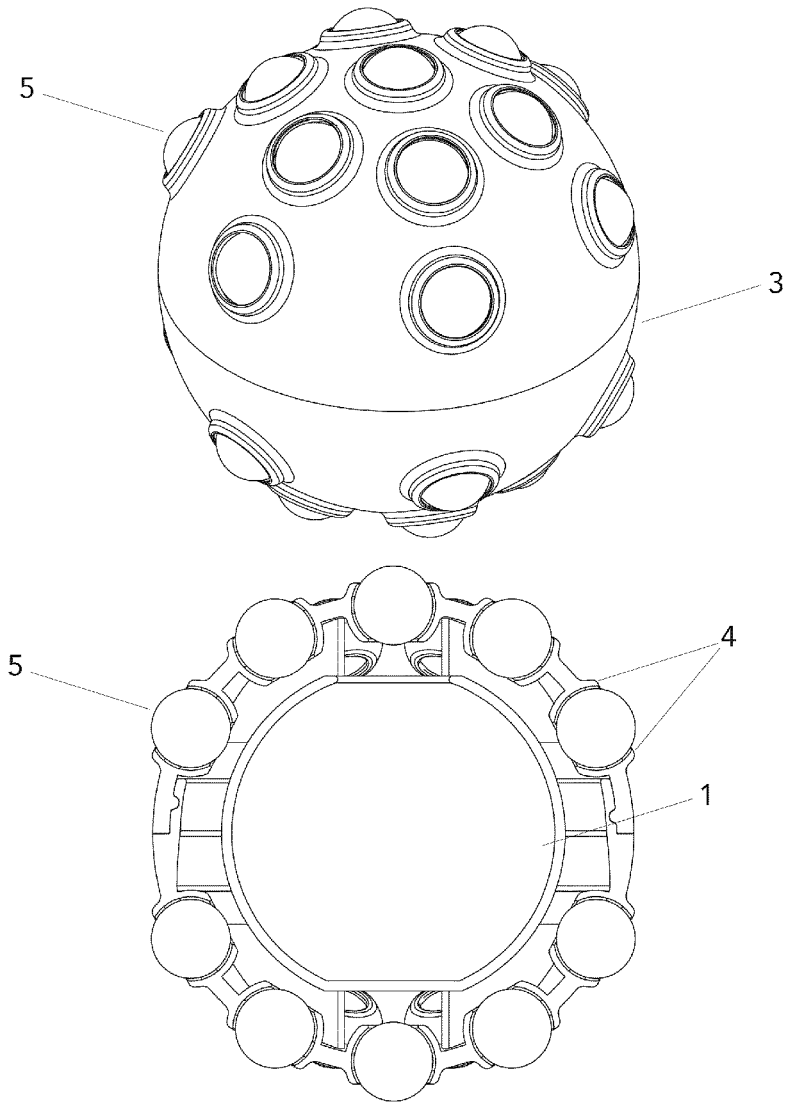
Figure 5:
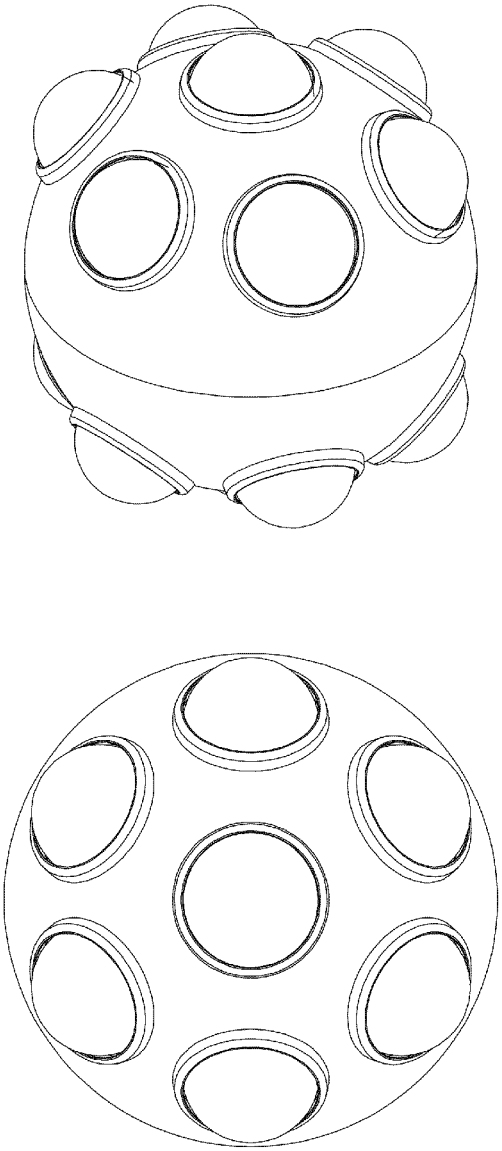
FIG. 5-6-7 represent different executions in accordance with the present invention.
Figure 6:
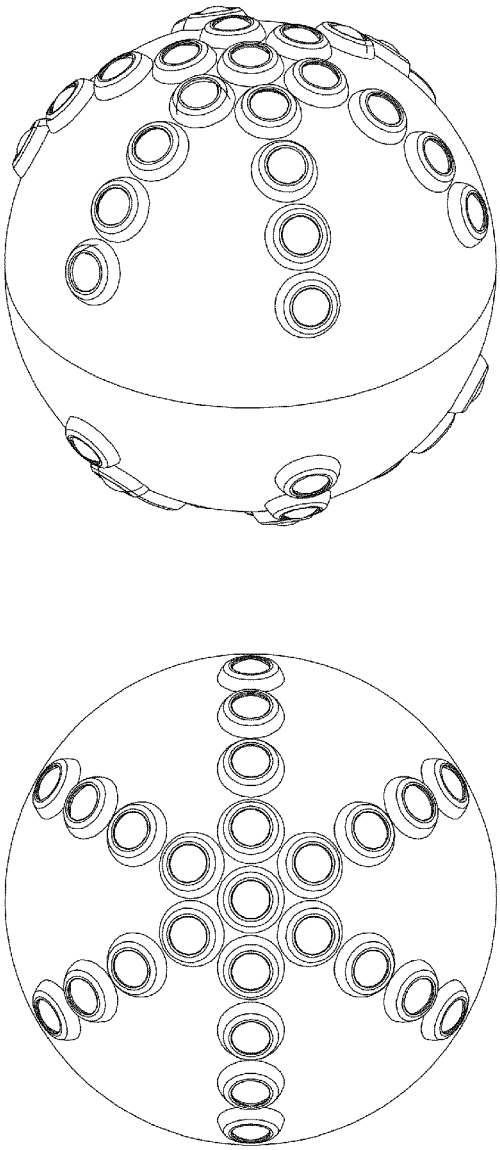
Figure 7:
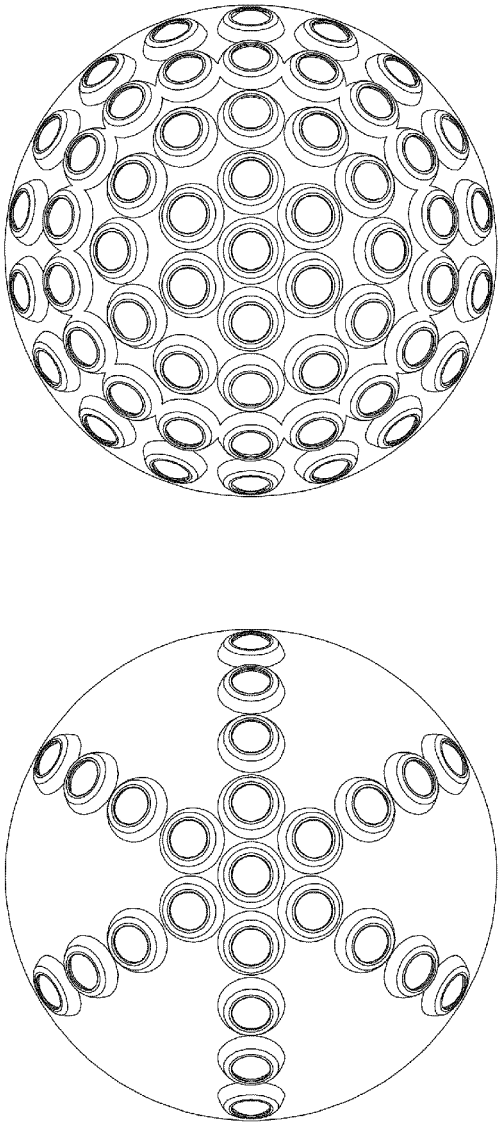

FIG. 3 and FIG. 4 represent a device for dosing and dispensing a detergent composition, said device comprising at least two reservoirs: a first inner hollow spherical shaped reservoir (1) having at least an opening (6) in which the detergent composition is inserted, an outer hollow spherical shaped reservoir (1), wherein the inner reservoir (5) is contained in the outer reservoir (1) and the outer reservoir (1) further comprises a plurality of ball retainers (2) wherein a freely rotating ball is seated (3) on the exterior surface of the outer reservoir.

In accordance with a preferred embodiment of the present invention, the inner reservoir (5) is contained in the outer reservoir (1), a hollow area is defined between the two, allowing for improved controlled dispensing of the detergent composition said detergent composition to be first dissolved in water and afterwards leaving the outer reservoir (1) via the freely rotating balls upon contact with the items to be washed.

In a preferred embodiment according to the present invention, the inner container (5) is contained within the outer container (1). The inner container comprises at least one opening (6) and the outer container embeds multiple ball retainers (2) wherein a freely rotating ball (3) is seated. This structural characteristic is key to the triggering of the detergent composition leaving the device and entering in contact with the items to be washed, allowing for a pre-dissolution of the detergent composition irrespective the form: liquid, solid, powder or any other form. Furthermore, it also increases the overall efficiency by allowing for a more controlled dispersing and cleaning efficiency of the detergent composition throughout the total duration of the cleaning process.

The outer reservoir (1) preferably comprises two parts: an upper and a bottom part. This is done to be able to open the device easily and (re)fill the inner reservoir (5) with detergent composition. The upper and the bottom part are preferably engaged to each other by fixing means. Such fixing means include: snap fittings, connectors, a connecting rim, a thread or the like and should allow the upper and the bottom part to be revolved easily. The inner reservoir (5) can be manufactured in one piece together with the bottom part of the outer reservoir (1).

In another embodiment according to the present invention, the inner reservoir (5) is interchangeable, so when empty, the entire inner reservoir (5) is replaced with a new one. Thanks to this feature, the person using the device according to the present invention is not entering in direct contact with the detergent composition, eliminating the risk of potentially unwanted allergic reactions.

In another embodiment according to the present invention, the inner reservoir (5) comprises predefined marked dosing levels on its surface, allowing the user to easily add the necessary quantity of detergent composition.

In another embodiment according to the present invention, the two outer parts of the outer reservoir (1) comprise fixing means such as fins (6), securing the inner reservoir (5) within the outer reservoir (1). Said fixing means also have an effect of guiding the detergent composition towards the freely rotating balls (3) embedded in the outer reservoir (1), and also improve the dissolving process.

In another embodiment according to the present invention, the inner reservoir (5) comprises at least four compartments, preferably at least three compartments, more preferably at least two compartments (5*a*, 5*b*). Such a structural characteristic allows said device to be used with at least two different detergent compositions which should not interact with each other while contained in the inner reservoir (5). This result is very important for detergent compositions having for example bleach sensitive active compounds. Such an inner reservoir (5) is also suitable for usage for more complex cleaning programs like: bleaching and washing, washing and rinsing, washing and softening, bleaching and washing and softening, or the like.

Further, the inner reservoir (5) defines a space in view of the outer reservoir (1) preferably of at least 15 mm, at least 10 mm, at least 7 mm or more preferably of at least 5 mm in circumference.

In another embodiment the outer reservoir (1) can also take the form of a sphere having a diameter of 100 mm, 90 mm, 70 mm or more preferably of 60 mm. This will ensure that the device according to the present invention is suitable for use in different applications that require different quantities of detergent composition.

In a preferred embodiment according to the present invention, inner reservoirs (5) of different diameters are usable with the same outer reservoir (1).

In another embodiment according to the present invention the device for dosing and dispensing a detergent composition comprises at least two reservoirs: a first inner hollow spherical shaped reservoir (1) having at least an opening (6) in which the detergent composition is inserted, an outer hollow spherical shaped reservoir (3), wherein the inner reservoir (5) is contained in the outer reservoir (1) and the outer reservoir (1) further comprises a plurality of ball retainers (2) wherein a freely rotating ball (3) is seated (3) on the exterior surface.

In another embodiment according to the present invention, the inner reservoir (5) comprises a plurality of openings on its surface. Depending on the application said openings are of different diameters for allowing a higher quantity of detergent composition to exit the inner reservoir (5) towards the outer container.

Further, in another embodiment according to the present invention, the inner reservoir (5) comprises a plurality of openings on its surface with different diameters depending on their location in view of the rotating balls of the outer reservoir (1), such as: a bigger diameter where freely rotating balls (3) on the outer reservoir (1) are not present and a smaller diameter where the freely rotating balls (3) on the outer reservoir (1) are present. This structural characteristic allows for a bigger quantity of detergent composition to leave the inner reservoir (5) and not leave the outer reservoir (1) without being dissolved.

In another embodiment according to the present invention, the device comprises freely rotating balls (3) occupying 70%, 60%, 40%, 30%, 10% or more preferably at least 20% of the surface of the outer reservoir (1).

Furthermore, said freely rotating balls (3) are made from any type of material selected from the group comprising: plastic, natural or synthetic rubber or fiber, depending on the type of items and conditions for washing.

The inner and/or the outer reservoir (5, 1) are made out of any type of material selected from the group comprising: any type of plastic, natural or synthetic rubber, or fiber. Furthermore, the inner and/or the outer reservoirs (5, 1) can be made from the same material or from different materials.

In another embodiment according to the present invention the inner and/or outer reservoirs (5, 1) have transparent sections or are entirely transparent, helping the user of a device according to the present invention to visualize the type and quantity of detergent composition contained therein.

In a further embodiment according to the present invention, the inner reservoir (5) is dissolvable in water, allowing for a very fast reuse of the device by simply replacing the used inner reservoir (5) with a new filled inner reservoir (5).

In another embodiment according to the present invention, said device is used as a laundry dosing and dispersing device.

The invention is further directed to a kit of parts comprising: a container comprising detergent composition, a device for dosing and dispensing the detergent composition comprising an inner reservoir (5) having at least an opening (6), an outer reservoir (1) embedding multiple ball retainers (2) wherein a freely rotating ball (3) is seated on the exterior surface of said device, wherein the inner reservoir (5) is contained in the outer reservoir (1) and wherein the device is removably attached to said container.

The container comprising the detergent composition is a bottle, a bag or a box, comprising at least an opening through which said detergent composition can be extracted.

In a preferred embodiment according to the present invention the container is a plastic bottle comprising liquid detergent composition and further comprising an opening secured by a plastic cap on which the device for dosing and dispensing the detergent composition is attached through a snap fitting connection or through a thread type of connection.

In another embodiment according to the present invention, such a kit of parts comprises a device for dosing and dispensing the detergent composition comprising an outer reservoir (1) embedding multiple ball retainers (2) wherein a freely rotating ball (3) is seated on the exterior surface and a plurality of disposable inner reservoirs (5) comprising detergent composition.

The invention is further directed to a process for washing textiles in a washing machine with the device for dosing and dispensing a detergent composition comprising an inner reservoir (5) having at least an opening (6), an outer reservoir (1) having at least a rotating ball (2), wherein the inner reservoir (5) is contained in the outer reservoir (1) and the outer reservoir (1) further comprises multiple ball retainers (2) wherein a freely rotating ball (3) is seated on the exterior surface of said device, comprising the steps of: adding detergent composition in the inner reservoir (5), placing the inner reservoir (5) in the outer reservoir (1) and securing the outer reservoir (1), placing the device for dosing and dispensing a detergent composition inside the washing machine together with the textiles.

In another embodiment according to the present invention, the inner reservoir (5) comprises at least two compartments (5*a*, 5*b*), making the device suitable for use with at least two different detergent compositions which should not interact with each other while contained in the inner reservoir (5).

The invention claimed is:

1. A laundry device for dosing and dispensing a detergent composition, said device comprising a reservoir wherein the surface of the reservoir comprises a plurality of ball retainers in which each freely rotating ball is seated, said freely rotating ball occupies at least 20% of the surface of the reservoir.

2. The device according to claim 1 whereby said freely rotating balls occupy 70%, 60%, 40%, or 30%, of the surface of the reservoir.

3. The device according to claim 2 whereby the surface of the ball is textured.

4. The device according to claim 3 whereby the interior surface of the recesses of the ball retainers have a smooth surface or are made out of a material different from the material of the rotating ball.

5. The device according to claim 4 whereby the device is spherical and whereby the device ranges from 6 to 10 cm in diameter having balls in a range of 0.5 to 2.5 cm or in a range of 1 to 2 cm in diameter.

6. The device according to claim 5 which has 360 degrees dispensing ability.

7. The device according to claim 1 whereby the surface of the ball is textured.

8. The device according to claim 1 whereby the interior surfaces of the recesses of the ball retainers have a smooth surface or are made out of a material different from the material of the rotating ball.

9. The device according to claim 1 whereby the device is spherical and whereby the device ranges from 6 to 10 cm in diameter having balls in a range of 0.5 to 2.5 cm or in a range of 1 to 2 cm in diameter.

10. The device according to claim 1 which has 360 degrees dispensing ability.

11. The device according to claim 1 wherein said reservoir has fixation means for receiving a detergent, said detergent being present as such or in the form of a tablet, pouch, water soluble pouch, or present in an additional reservoir.

12. The device according to claim 11 where the distance between the detergent and a container causes mixing and dispensing of the detergent towards the inner surface of the container.

13. The device for dosing detergent compositions according to claim 1, wherein an inner reservoir defines a space in view of an outer reservoir to allow mixing and dispensing of the detergent towards the inner surface of the container.

14. The device for dosing detergent compositions according to claim 1, wherein the inner reservoir comprises a plurality of openings on its surface.

15. The device for dosing detergent compositions according to claim 1, wherein the freely rotating balls are made from a material selected from a group comprising plastic, rubber, or fiber.

16. A device for dosing and dispensing a detergent composition, said device comprising:

an inner reservoir comprising at least an opening;

an outer reservoir;

the inner reservoir is container in the outer reservoir further in that the surface of the outer reservoir comprises a plurality of ball retainer wherein a freely rotating ball is seated, said freely rotating ball occupies at least 20% of the surface of the reservoir.

17. The device according to claim 16 for dosing detergent compositions, said device comprising a reservoir wherein the surface of the reservoir comprises a plurality of ball retainers in which each freely rotating ball is seated, wherein the inner reservoir comprises at least two compartments.

18. The device for dosing detergent compositions according to claim 16, wherein the inner reservoir is dissolvable in water and/or the inner reservoir is interchangeable.

19. A kit of parts comprising:

a detergent composition; and a device for dosing and dispensing the detergent composition comprising an inner reservoir having at least an opening, an outer reservoir, wherein the inner reservoir is contained in the outer reservoir, the outer reservoir further comprises a plurality of ball retainers wherein a freely rotating ball is seated on the exterior surface of said device and, said freely rotating balls occupy at least 20% of the surface of the reservoir.

* * * * *